United States Patent [19]

Popplewell et al.

[11] 4,246,960

[45] Jan. 27, 1981

[54] FAIL SAFE HEAT EXCHANGER

[75] Inventors: James M. Popplewell, Guilford, Conn.; Sheldon H. Butt, Godfrey, Ill.

[73] Assignee: Olin Corporation, New Haven, Conn.

[21] Appl. No.: 23,631

[22] Filed: Mar. 26, 1979

[51] Int. Cl.[3] ..... F28F 19/00; F28F 21/08

[52] U.S. Cl. ..... 165/134 R; 165/164; 165/170; 165/DIG. 8; 428/933

[58] Field of Search ..... 165/134, 164, 133, 165, 165/DIG. 8, 180, 170, 171; 428/933

[56] References Cited

U.S. PATENT DOCUMENTS

| | | | |
|---|---|---|---|
| 2,017,676 | 10/1935 | Girsewald et al. | 165/134 |
| 2,690,002 | 9/1954 | Grenell | 165/170 |
| 2,795,402 | 6/1957 | Modine | 165/134 |
| 2,960,114 | 11/1960 | Hinde | 165/134 |
| 3,117,621 | 1/1964 | Bockhorst | 165/171 |
| 3,265,125 | 8/1966 | Rosenblatt | 165/134 |
| 3,355,267 | 11/1967 | Du Rose | 428/933 |

FOREIGN PATENT DOCUMENTS

| | | | |
|---|---|---|---|
| 610484 | 10/1960 | Italy | 165/180 |
| 578003 | 6/1946 | United Kingdom | 165/180 |

*Primary Examiner*—Sheldon J. Richter

*Attorney, Agent, or Firm*—Victor A. DiPalma; Paul Weinstein

[57] ABSTRACT

A multiple passage metal heat exchanger is disclosed which contains a metal barrier between sets of passageways. The barrier is cathodic to the metal of the heat exchanger and prevents intermixing of different heat transfer fluids due to corrosion.

11 Claims, 3 Drawing Figures

FAIL SAFE HEAT EXCHANGER

BACKGROUND OF THE INVENTION

This invention relates to an improved heat exchanger having primary and secondary fluid passages with a nickel rich barrier interposed therebetweeen. These panels find particular application in heat exchange systems which utilize primary and secondary fluids, whether gas or liquid, which should not be intermixed as a result of corrosion effects.

In many heat exchange systems utilizing two or more heat transfer fluids intermixing of the fluids is highly undesirable and or dangerous. For example, an ethylene glycol base anti-freeze solution may be used in the primary loop of a solar heat exchanger to avoid freezing of the solar absorber panels during cold weather. In such a system the secondary loop may contain water which may be used for drinking or in household appliances. Ethylene glycol is highly toxic and it can readily be seen that intermixing of the ethylene glycol with the water would be quite dangerous.

Another example of undesirable mixtures of primary and secondary heat exchange fluids would be the use of an organic heat transfer fluid in the primary loop which may contaminate water in the secondary loop. Other examples would include cases where the two fluids are chemically incompatible or where a safety hazard may result.

PRIOR ART STATEMENT

Use of nickel layers to control corrosion affects is exemplified in U.S. Pat. No. 3,355,267 to Du Rose which shows layers of nickel and nickel alloy plates between a metal base and a chromium plate.

A multiple passage tube in sheet heat exchanger incorporating an atmospheric barrier between primary and secondary passages is depicted in U.S. Pat. No. 3,117,621 to Bockhorst. Tube in sheet type heat exchange panels have been made commercially for many years by the ROLL-BOND ® process as exemplified in U.S. Pat. No. 2,690,002 to Grenell. These panels have found wide commercial application in refrigerator heat exchangers and in the field of solar energy as absorber panels, etc.

As noted above, ROLL-BOND ® panels fabricated from copper and its alloys have many uses in heat exchanger applications. For example, they can be used as part of a solar collector system, either as flat plate absorber panels or as a heat exchanger used to transfer heat from the primary solar collector loop to a storage facility or secondary loop. This can be done by circulating the heat transfer fluid in the primary loop through the heat exchanger which may be immersed in or may surround a storage tank containing another fluid. A more efficient design would be a counter type heat exchanger where both primary and secondary loops were included in the same ROLL-BOND ® configuration. In all cases, should corrosion occur by interaction between the primary or secondary fluid and the copper alloy, perforation may result in mixing of the two fluids.

SUMMARY OF THE INVENTION

In accordance with this invention an improved fail safe heat exchanger panel is provided, whereby two or more separate fluids are prevented from mixing should corrosion occur. This invention relies on the principle of galvanic protection whereby should corrosion of the passage occur by one fluid, penetration into the other fluid is prevented.

The principle applies mainly to systems using at least one aqueous fluid, since corrosion is less likely in organic systems except where contamination by some electrolyte occurs. In addition, it is not necessarily restricted to solar systems and may find application in other heat transfer areas.

In accordance with this invention primary and secondary fluid passages constructed of metal or alloy are separated by a layer of metal or alloy which is noble to the metal or alloy of the fluid passages. In aqueous media the noble metal or alloy becomes the cathode of an electrolytic cell. Penetration is prevented therefore, and any additional corrosion can only occur in the metal or alloy of the fluid passages. The favorable large anode, small cathode that exists will insure that further corrosion will not be rapid. Under such an arrangement the heat exchange system will leak externally before the heat exchange fluids intermix. The noble metal or alloy layer is made sufficiently thin to allow good heat transfer between the primary and secondary fluids of the heat exchanger.

Accordingly, it is an object of this invention to provide an improved fail safe heat exchanger panel.

This and other objects will become more apparent from the following description and drawings.

DETAILED DESCRIPTION OF THE PREFERRED EMBODIMENTS

Figure 1:
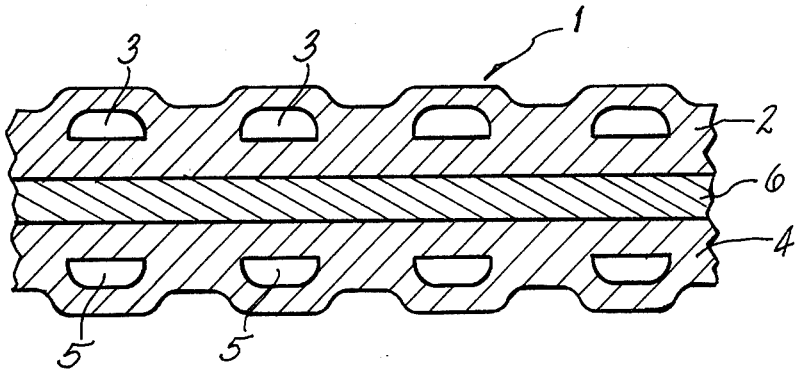
FIG. 1 is a partial cross sectional view of one embodiment of the fail safe heat exchanger of this invention showing a noble metal layer interposed between sets of primary and secondary fluid passages.

Referring now to FIG. 1 there is illustrated by way of example a heat exchange panel 1 useful in applications involving use of separate heat exchange fluid passage systems within one heat exchange panel. Heat exchanger 1 comprises stacked tube in sheet panels 2 and 4. Corrosion barrier layer 6 is interpoed between stacked tube in sheet panels 2 and 4 to prevent fluid from a first set of passages 3 within panel 2 from intermixing with fluid from a second set of passages 5 within panel 4. In accordance with this invention corrosion barrier layer 6 comprises at least in part a metal which is noble to the metal of panels 2 and 4.

Tube in sheet panels 2 and 4 and corrosion barrier layer 6 could be assembled to form heat exchanger 1 by any suitable means such as for example by bolting, brazing, etc.

In a preferred embodiment of this invention tube in sheet panels 2 and 4 are constructed of copper alloy while corrosion barrier 6 comprises a nickel sheet or foil.

Use of ROLL-BOND® panels and forming techniques as disclosed in U.S. Pat. No. 2,690,002 to Grenell and other processes of joining and forming which use high pressure and/or temparature ranges might lead to the heat exchanger structure illustrated in FIG. 2 The heat exchanger 10 is FIG. 2 comprises two sets of fluid passages 3 and 5 separated by a corrosion barrier layer 6. However, as a result of pressure and/or temperature application during joining, forming, heat treating, etc. diffusion zones 8 form adjacent to barrier layer 6. While diffusion zones 8 tend to act as a corrosion resistant barrier layer it is nevertheless essential that a substantially continuous corrosion barrier layer 6 be maintained between distinct fluid heat exchange systems wherein-termixing as a result of corrosion is to be avoided. Corrosion barrier layer 6 can be of nay thickness so long as continuity is maintained, and thicknesses as small as approximately one ten thousandths of an inch might be satisfactory. Thus, barrier layer 6 can be maintained sufficiently thin to allow good heat transfer.

Figure 2:
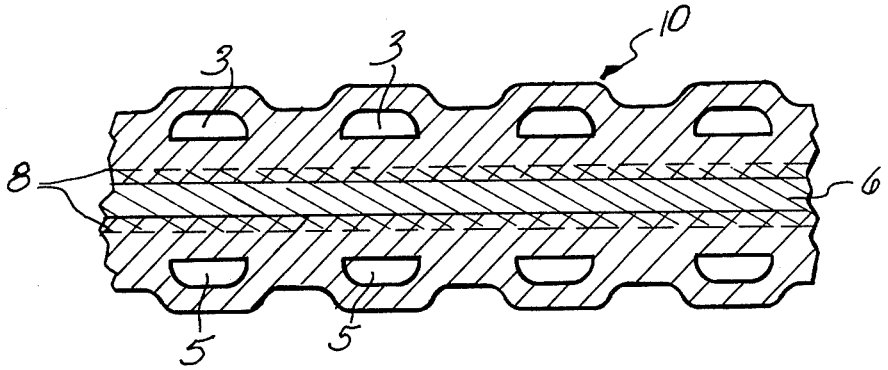
FIG. 2 is a partial cross sectional view of a second embodiment of the fail safe heat exchanger of this invention showing a noble metal layer interposed between sets of primary and secondary fluid passages, and additionally showing a diffusion zone adjacent said layer.

Thus the embodiment of FIG. 2 might be constructed of two copper alloy ROLL-BOND® panels with appropriate tube configurations separated by a thick nickel layer which is bonded metallurgically during processing or by a diffusion anneal. A thin diffusion layer consisting of copper nickel alloy would then be present adjacent the nickel corrosion barrier layer. Should corrosion occur in either side of the heat exchanger, it will eventually penetrate through to the nickel layer. However, because nickel is noble to copper it becomes the cathode of an electrolytic cell. Penetration is prevented therefore, and any additional corrosion can only occur in the copper alloy portion of the heat exchanger. The favorable large anode, small cathode that exists will ensure that further corrosion will not be rapid. Penetration from both sides to the nickel layer will still insure that the fluids do no intermix.

Figure 3:
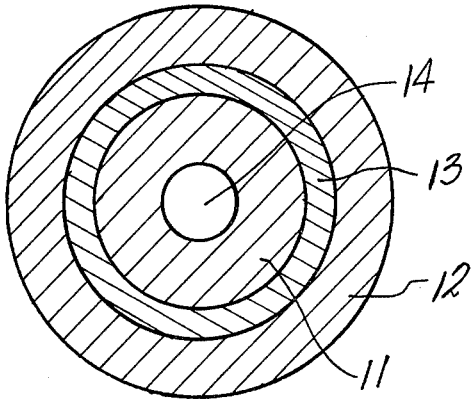
FIG. 3 is a partial cross sectional view of a third embodiment of the fail safe heat exchanger of this invention showing a noble metal layer interposed between concentric tubes of a tubular heat exchanger.

In the embodiment of FIG. 3 a tubular heat exchanger encompassing the fail safe characteristics of this invention is shown which comprises concentric inner and outer tubes 11 and 12 which are secured together with a corrosion barrier layer 13 interposed therebetween.

Tubes 11 and 12 might typically be constructed of copper alloy while corrosion barrier layer 13 might consist of a nickel rich layer. Thus upon corrosion of tubes 11 and 12 layer 13 would act as a cathode of an electrolytic cell thereby preventing through corrosion and intermixing of heat exchange fluid found within passage 14 and fluid outside outer tube 12.

Tubes 11 and 12 with corrosion barrier 13 therebetween could be mechanically assembled or could be assembled by working with or without heat treatment, leading to a resulting diffusion zone similar to the one shown in FIG. 2.

Methods of achieving the nickel rich layer of the preferred embodiment is described in the following examples.

EXAMPLE 1

An appropriate pattern is silk screened onto two CA 122 copper sheets with a non-graphite stopweld according to normal copper ROLL-BOND® practice. A similar sheet with no stopweld is placed over the top and tack welded. A nickel powder slurry consisting of nickel powder in a binder is silk screened, painted or sprayed onto one of the surfaces of one or both of the tack welded subassemblies covering the whole surface. The two tack welded halves are then stacked with the nickel layer in the middle and tack welded together. The whole is then processed according to conventional ROLL-BOND® practices. The heating/deformation cycles are sufficient to cause the bonding of the two halves.

EXAMPLE 2

Specimens were prepared as in Example 1 except that prior to or after inflation, annealing in air vacuum or inert atmosphere is carried out for 15 minutes to 8 hours at a temperature of 300°–1050° C.

EXAMPLE 3

Specimens are prepared as in Example 1 except that a nickel sheet or foil is used in place of the powder slurry.

EXAMPLE 4

Specimens were prepared as in Example 3 except that prior to or after inflation, annealing in air, vacuum or inert atmosphere was carried out for 15 minutes to 8 hours at a temperature of 300°–1050°.

While the above discussion of preferred embodiments describes stacked or layered tube in sheet panels forming a heat exchanger in accordance with this invention it should be understood that other forms of heat exchanger can be rendered fail safe in accordance with this invention. For example, a panel or other type heat exchanger having primary and secondary fluid passages located in one plane can be rendered fail safe by inclusion between the fluid passages of a barrier layer noble to the material forming the passages. Moreover, the metals and alloys which form the passages and barrier layers may be varied as desired as long as the metal of the barrier layer is noble to the metal which forms the fluid passages.

The patents set forth in this specification are intended to be incorporated by reference herein.

It is apparent that there has been provided in accordance with this invention an improved fail safe heat exchanger which fully satisfies the objects, means and advantages set forth herein before. While the invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. A fail safe metal heat exchanger comprising copper or a copper alloy, said heat exchanger comprising juxtaposed primary and secondary fluid passageways integral with and separated by a corrosion barrier comprising nickel or a nickel alloy which is noble to said copper or copper alloy of the remainder of said heat exchanger; whereby said corrosion barrier is adapted to prevent intermixing between a fluid in said primary passageway and a fluid in said secondary passageway.

2. The heat exchanger of claim 1 wherein said corrosion barrier comprises a metallic foil.

3. The heat exchanger of claim 1 wherein said corrosion barrier comprises a nickel sheet.

4. A composite fail safe metal heat exchanger comprising:

a first metal panel comprising copper or a copper alloy having at least one fluid passageway;

a second metal panel comprising copper or a copper alloy having at least one fluid passageway;

said first and second metal panels being arranged in juxtaposition;

a substantially continuous corrosion barrier;

said corrosion barrier comprising nickel or a nickel alloy which is noble to the metal of said first and second panels; and said corrosion barrier being located between and in intimate contact with said first and second panels; whereby said corrosion barrier is adapted to prevent intermixing between a fluid in said passageway of said first metal panel and a fluid in said passageway of said second metal panel.

5. The heat exchanger of claim 4 wherein said first and second metal panels are of the tube in sheet type.

6. The heat exchanger of claim 4 wherein said first and second panels and said corrosion barrier are metallurgically bonded together to form said composite heat exchanger.

7. The heat exchanger of claim 4 wherein said first and second panels are diffusion bonded to said corrosion barrier whereby a diffusion zone exists at the interface of each said panel and said corrosion barrier.

8. The heat exchanger of claim 7 wherein said diffusion zone comprises copper nickel alloy.

9. The heat exchanger of claim 4 wherein said first and second panels and said corrosion barrier are mechanically fastened together to form said composite heat exchanger.

10. The heat exchanger of claim 4 wherein said corrosion barrier comprises a metallic sheet.

11. The heat exchanger of claim 4 wherein said corrosion barrier comprises a nickel foil.

* * * * *